US006752590B2

(12) United States Patent
Serio

(10) Patent No.: US 6,752,590 B2
(45) Date of Patent: Jun. 22, 2004

(54) WATER PUMP AND IMPELLER THEREFOR

(75) Inventor: John A. Serio, Lake In The Hills, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 21 days.

(21) Appl. No.: 10/255,332

(22) Filed: Sep. 26, 2002

(65) Prior Publication Data

US 2004/0062635 A1 Apr. 1, 2004

(51) Int. Cl.[7] ..... F04D 29/10

(52) U.S. Cl. ..... 415/112; 415/115; 415/180; 416/181

(58) Field of Search ..... 415/106, 111, 415/112, 115, 180; 416/181; 417/423.3, 423.1

(56) References Cited

U.S. PATENT DOCUMENTS

| | | | | |
|---|---|---|---|---|
| 3,213,794 A | * | 10/1965 | Adams | 417/69 |
| 4,778,341 A | * | 10/1988 | Corradini et al. | 416/181 |
| 5,131,809 A | | 7/1992 | Gesenhues et al. | |
| 5,660,521 A | | 8/1997 | Serio | |
| 5,827,041 A | | 10/1998 | Charhut | |
| 6,079,942 A | | 6/2000 | Weir et al. | |

* cited by examiner

*Primary Examiner*—Edward K. Look
*Assistant Examiner*—Dwayne J. White
(74) *Attorney, Agent, or Firm*—Dennis Kelly Sullivan; Susan L. Lukasik; Jeffrey P. Calfa

(57) ABSTRACT

A water pump (10) and impeller (30) for use in applications such as internal combustion engines. A plurality of holes (40, 44) are formed near the hub and periphery of the impeller (30) of the water pump to provide coolant flow through a cavity (22) housing a seal. The seal (18) is thereby cooled to prevent premature failure of the seal (18) due to overheating.

15 Claims, 3 Drawing Sheets

WATER PUMP AND IMPELLER THEREFOR

FIELD OF THE INVENTION

This invention relates to water pumps for internal combustion engines, including but not limited to, water pump impellers.

BACKGROUND OF THE INVENTION

Internal combustion engines typically include a water pump having a pump chamber, and an impeller on a rotating shaft that extends through the pump chamber. A seal assembly within the water pump housing may include two seal faces, which may be of carbon, silicon carbide, or ceramic face material. The mating face rotates with the shaft, and the seal face is pressed into a bearing housing and does not rotate. Absent coolant circulation about the seal, the coolant adjacent to and in between the seal faces becomes hot, boils, and vaporizes, causing residue to be deposited on the face. This residue reduces the seal's ability to retain the liquid in the pump chamber. If lack of coolant circulation about the seal persists, the seal chamber becomes dry and overheated, causing the seal to fail.

High temperature environments at the seal face reduce the life of the seal and necessitate early replacement of the water pump. Extending the life of a seal is desirable to reduce maintenance expenses of engines. Proper water pump function is important to maintain basic engine operation.

Methods and assemblies that reduce heat build up at the seal have been proposed. These approaches introduce complex assembly and manufacturing operations and add cost to the overall engine. Examples of these approaches are found in U.S. Pat. Nos. 5,827,041 and 6,079,942. The U.S. Pat. No. 5,827,041 patent describes a water pump having a shrouded chamber around the seal. Fluid channels are machined in the housing to direct coolant flow to the area around the seal for transfer of heat dissipated by the seal. The added components of the seal shroud and the manufacturing operations forming the fluid channels increase the complexity and cost of the water pump. The U.S. Pat. No. 6,079,942 patent introduces an additional flushing ring to circulate the fluid evenly around the seal. The flushing ring introduces additional components and manufacturing and assembly costs to the water pump.

Accordingly, there is a need for an apparatus for reducing heat build-up around a seal for a water pump without significantly increasing the complexity and cost of the water pump.

SUMMARY OF THE INVENTION

The invention provides a simple and inexpensive apparatus to provide a sufficient flow of coolant over and around a water pump seal to cool and lubricate the seal and thereby extend the life of the seal. A fluid path through the impeller directs coolant from a high pressure area of the pump near the outer periphery of the impeller and through the body of the impeller to a seal cavity proximate the seal. The coolant is drawn from the seal cavity through the impeller at the hub proximate the seal to return the coolant to the low pressure area of the pump. In a preferred embodiment, holes are provided in the impeller respectively adjacent the periphery and adjacent the drive shaft to provide a cooling circuit including the seal cavity.

DESCRIPTION OF THE PREFERRED EMBODIMENT

The following describes a water pump, which is useful, for example, in applications such as internal combustion engines. A plurality of holes are formed in the body of the impeller of the water pump to provide coolant flow through a cavity where a seal is found along a drive shaft. The seal face is thereby provided additional cooling to prevent premature failure of the seal due to overheating.

Figure 1:
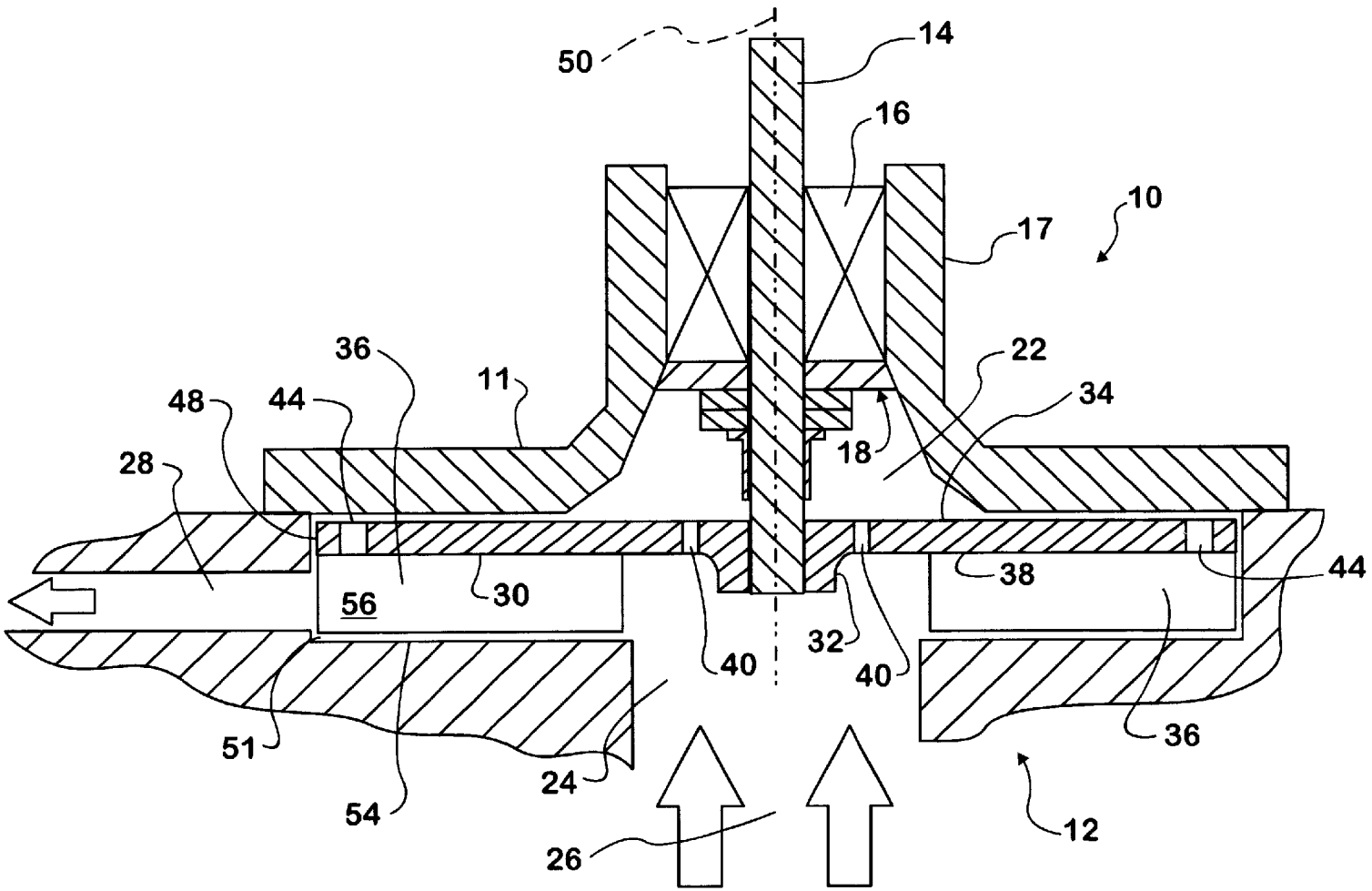
FIG. 1 is a cross-section of a water pump in accordance with the present invention.
Figure 3:
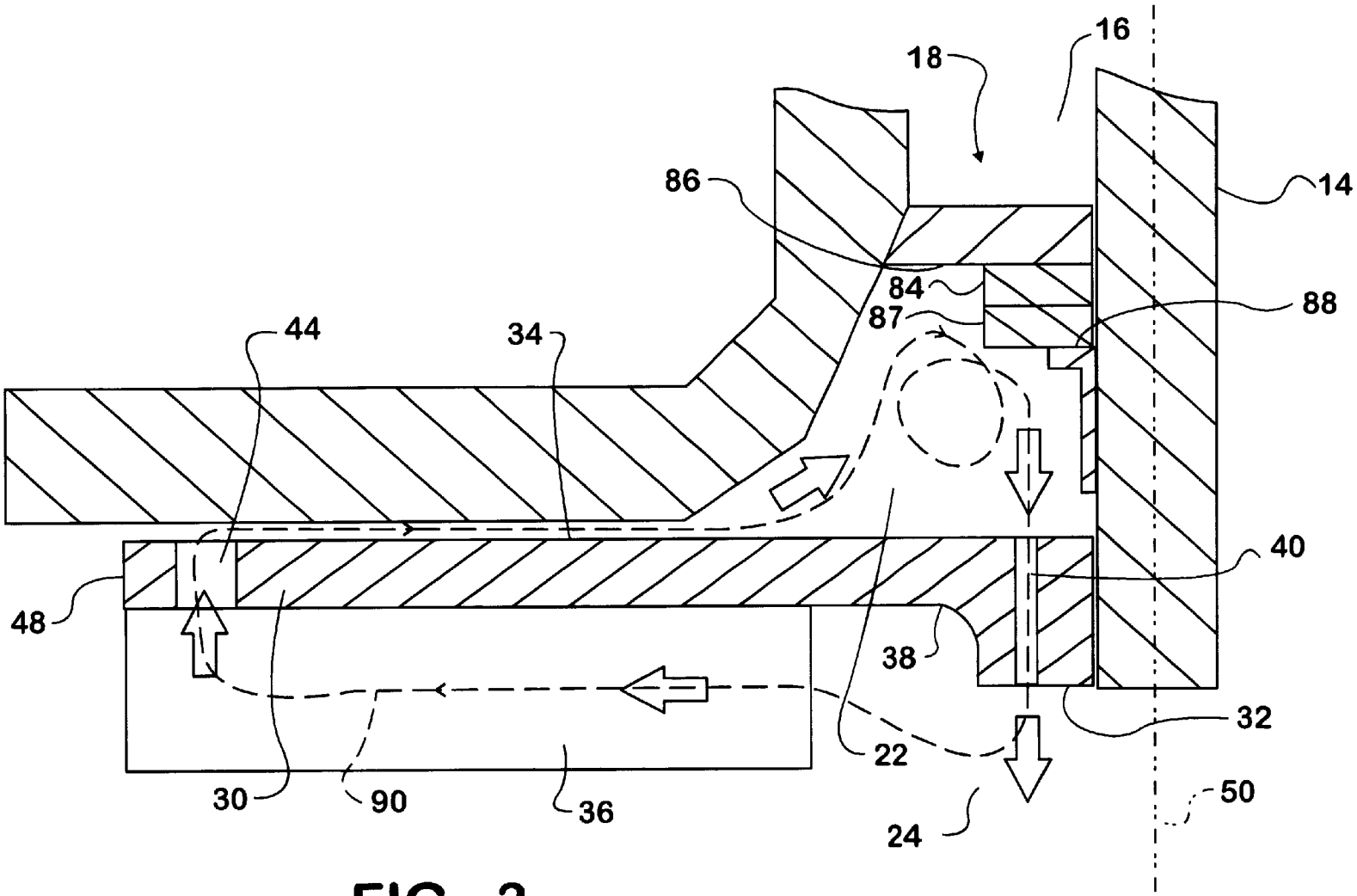
FIG. 3 is a cross-section illustrating a fluid path in the water pump in accordance with the present invention.

Referring now to the drawings, FIG. 1 illustrates a water pump 10 having a pump housing 11 mounted on an engine block 12 of an internal combustion engine. A drive shaft 14 is rotatably mounted on a bearing assembly 16 mounted in a bearing housing portion 17 of the pump housing 11. A mechanical face seal assembly 18 is mounted between the bearing housing portion 17 and the drive shaft 14 to prevent leakage of coolant from the seal chamber 22 to the bearing assembly 16. An impeller 30 is mounted on the drive shaft 14 in a pump chamber 24. A hub 32 of the impeller 30 engages the drive shaft 14. The hub 32 may be an integral part of the impeller 30 or may be a separate device disposed on and/or connected to the impeller 30. The impeller 30 is preferably round in shape, and has a plurality of vanes 36 integrally formed on one side 38. A plurality of hub holes 40 are formed, preferably by drilling or casting, in the impeller 30 near the drive shaft 14 and the hub 32, or as shown in FIG. 3 through the hub 32. Each of the hub holes 40 forms a single passageway that extends through the hub 32 from one side 38 of the impeller 30 through to the other side 34 of the impeller. The hub holes 40 are positioned so flow of coolant from the seal chamber 22 to the pump chamber 24 is not blocked by the seal assembly 18. The hub holes 40 provide a return path for coolant to flow from the seal chamber 22 to the pump chamber 24 adjacent to the inlet port 26.

A plurality of periphery holes 44 are formed in the impeller 30 near an outer peripheral edge 48 of the impeller 30. The periphery holes 44 extend from one side 38 of the impeller 30 to the other side 34 of the impeller, thereby forming a passageway through the impeller 30. The periphery holes 44 provide a supply path (as shown in FIG. 3) from the pump chamber 24 to the seal chamber 22.

The drive shaft 14 rotates about its axis 50, thereby propelling the coolant away from the hub 32, along the vanes 36, and in a direction toward the outer peripheral edge 48 of the impeller. The vanes 36 have narrow clearance 51 with the volute cover 54 thereby forcing the coolant to flow between the vanes toward the outer edge 48 of the impeller 30 and creating a high pressure area 56 within the pump 10 near the outer peripheral edge 48 of the impeller. The flow of coolant also creates a suction force that generates a low pressure area proximate the hub 32 in the pump 10. The coolant is thereby sucked from the inlet port 26 and from the hub holes 40, forced by the vanes 36 toward the outer edge 48, and directed out of the pump chamber 24 toward a discharge port 28 and into the periphery holes 44.

Figure 2:
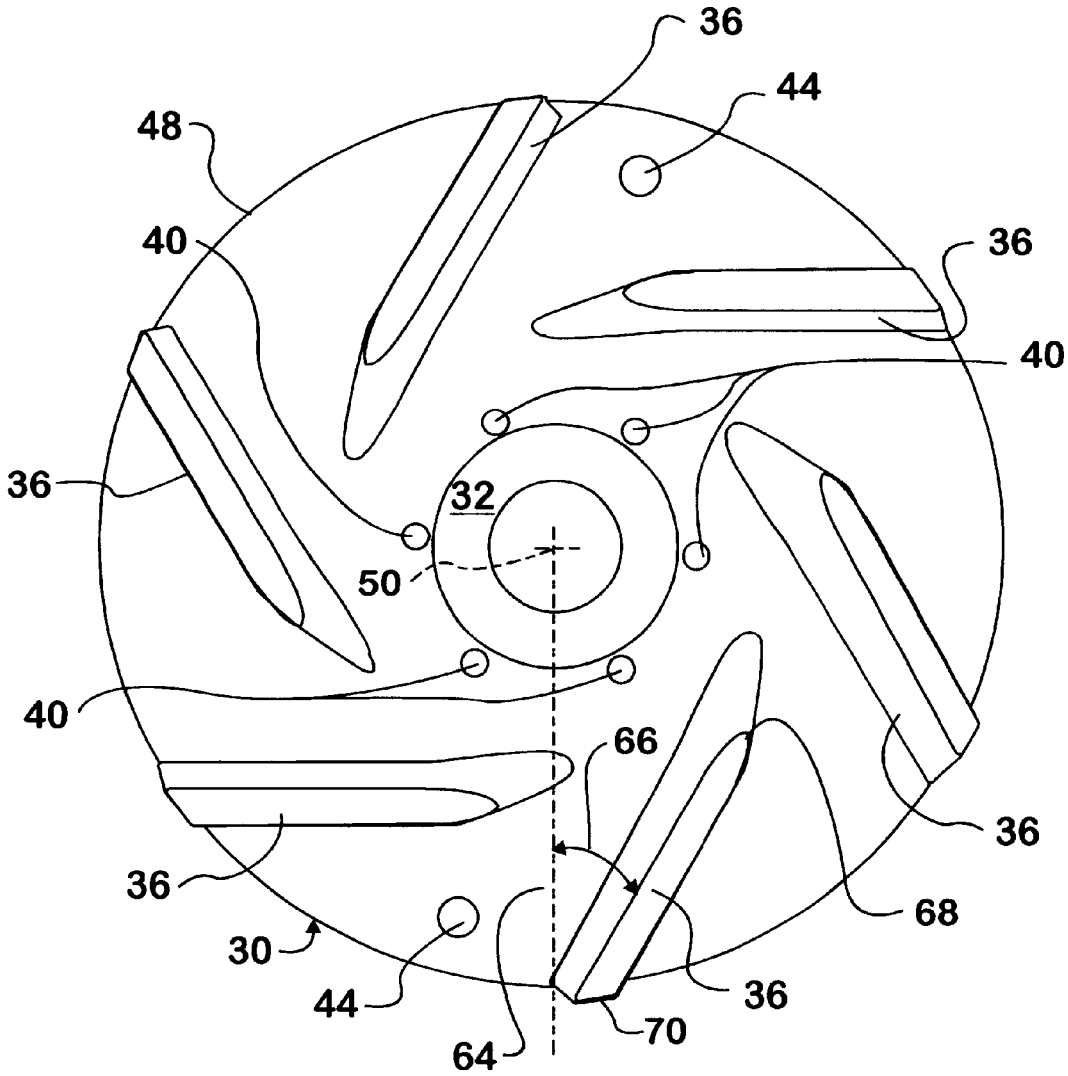
FIG. 2 is an end view of an impeller for a water pump in accordance with the present invention.

An end view of the impeller is shown in FIG. 2., the vanes 36 extend generally from near the hub 32 outwardly toward the outer edge 48 of the impeller 30. The vanes 36 may be positioned along a radius 64 of the impeller 30 or at an angle 66 to the radius 64. The vanes 36 have an inner end 68 and an outer end 70. Hub holes 40 and periphery holes 44 may be cast or machined in the impeller 30. Advantageously, the impeller 30 has six hub holes 40 spaced equally around the axis 50, i.e., every 60°, and equidistant to the axis 50 of the impeller 30. Advantageously, two periphery holes 44 are formed near the outer edge 48 of the impeller 30 and spaced 180 degrees apart. The area of each of the periphery holes 44 is larger than the area of each of the hub holes 40 so that the combined area of the peripheral holes 44 is approximately equal to that of the hub holes 40 Taking into account that the periphery holes 44 should be spaced from the outer edge 48 to prevent damage to the impeller 30, the periphery holes 44 are advantageously formed at a radial position on the impeller 30 where the highest pressure is formed by the impeller 30, the vanes 36, and the volute cover 54.

A cross-section illustrating the fluid path in the water pump is shown in FIG. 3. The mechanical face seal assembly 18 includes a fixed metal seal carrier 86 pressed into the bearing housing 16 to prevent rotation of the carrier, and a rotating metal seal carrier 88 mounted to the drive shaft 14 for rotation therewith, each of the carriers carrying a carbon or silicon carbide or ceramic seal face 84, 87. Although seal cavities in the prior art are filled with coolant, absent coolant circulation about the seal 18, coolant adjacent the seal faces 84, 87 becomes hot, boils, and vaporizes, causing residue to be deposited on the seal faces. The residue reduces the ability of the seal assembly 18 to retain the coolant in the pump chamber 24. The seal chamber 22 may become dry and overheated, causing the seal 18 to fail.

In accordance with the present invention, the seal chamber 22 is in fluid communication with the hub holes 40 and the periphery holes 44. Coolant flows from a high pressure area near the outer edge 48 of the impeller 30, through the periphery holes 44 into the seal chamber 22, and out through the hub holes 40 to the low pressure area close to the hub 32.

A fluid path 90 about the impeller 30 proceeds through the hub holes 40, in a direction toward the outer edge 48 of the impeller, through the periphery holes 44, back toward the drive shaft 14 and the seal assembly 18, and through the hub holes 40. The coolant circulates along the fluid path through the impeller to cool and lubricate the seal 18.

The present invention provides a number of advantages. The holes formed in the impeller may be machined or cast at the time of impeller manufacture to minimize handling and manufacturing costs. The present invention does not require addition parts that have costs and manufacturing time associated with them. Thus, a cooling fluid path is provided with minimum additional assembly costs. The present invention allows for the use of existing housing and seal components of the water pump; thus existing water pumps may be easily retrofitted with the impeller of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A water pump comprising:

a housing having a pump chamber and a seal chamber;

an impeller, disposed for rotation in the housing between the pump chamber and the seal chamber, the impeller having a hub and an outer edge, and a plurality of hub holes are formed near the hub and at least one periphery hole is formed near the outer edge of the impeller, such that a fluid path is formed between the pump chamber and the seal chamber through the hub holes and the at least one periphery hole.

2. The water pump of claim 1, wherein the fluid path comprises a source path from the pump chamber through the periphery holes and into the seal chamber.

3. The water pump of claim 1, wherein the fluid path comprises a return path from the seal chamber through the hub holes and into the pump chamber.

4. The water pump of claim 1, wherein coolant circulates along the fluid path and cools a seal disposed within the seal chamber.

5. The water pump of claim 1, further comprising at least two periphery holes spaced equally about a drive shaft.

6. The water pump of claim 1, wherein the hub holes are spaced equally about a drive shaft.

7. The water pump of claim 1, wherein the seal chamber is formed between a seal assembly disposed between the pump housing and a drive shaft, and the impeller.

8. The water pump of claim 7, wherein a portion of the seal assembly is mounted on the drive shaft.

9. The water pump of claim 1, wherein the impeller comprises a plurality of vanes disposed within the pump chamber.

10. The water pump of claim 9, wherein rotation of the impeller causes the vanes to create high pressure areas and low pressure areas within the pump chamber to thereby cause fluid to flow along the fluid path.

11. An impeller comprising:

an impeller having a peripheral edge and a hub portion defining an inner periphery wherein a plurality of first holes are formed in the impeller near the inner periphery and a periphery hole is formed near the peripheral edge;

a plurality of vanes disposed on a first side of the impeller wherein a fluid path is formed along the first side of the impeller through the first holes, along the vanes, toward the periphery hole, and through the periphery hole, and along a second side of the impeller and toward the first holes when the impeller rotates.

12. The apparatus of claim 11, wherein a plurality of periphery holes are spaced equally about and equidistant to a center of the impeller.

13. The apparatus of claim 11, wherein the plurality of first holes is spaced equally about and equidistant to a center of the impeller.

14. A water pump comprising:

a housing;

a seal disposed within the housing;

an impeller having an inner periphery and an outer edge, wherein a periphery hole is formed near the outer edge, said impeller having a hub portion near the inner periphery;

a seal chamber formed between the seal, the housing, and a first side of the impeller;

a plurality of hub holes are formed near the inner periphery such that a passageway is provided through the impeller;

a plurality of vanes disposed on a second side of the impeller and within a pump chamber in said housing;

wherein a fluid path is formed about the impeller, such that when the impeller rotates, fluid flows from the seal chamber, through the hub holes into the pump chamber, along the plurality of vanes in a direction toward the outer edge, through the periphery hole, and across the first side of the impeller in a direction toward the hub, thereby cooling the seal.

15. The water pump of claim 14, wherein coolant is forced to flow along the plurality of vanes, thereby creating a high pressure area within the water pump near the outer edge of the impeller while generating a low pressure area near the hub, causing fluid to flow along the fluid path.

* * * * *